United States Patent [19]

Kouchich et al.

[11] 4,064,475

[45] Dec. 20, 1977

[54] THICK FILM VARISTOR AND METHOD OF MAKING THE SAME

[75] Inventors: Allan V. Kouchich, Milwaukee; Robert Marshall, Mequon, both of Wis.

[73] Assignee: Allen-Bradley Company, Milwaukee, Wis.

[21] Appl. No.: 704,152

[22] Filed: July 12, 1976

[51] Int. Cl.[2] ..... H01C 7/10

[52] U.S. Cl. ..... 338/20; 29/610 R; 29/613; 29/621; 338/274; 338/308; 338/327; 338/329; 427/103

[58] Field of Search ..... 338/20, 21, 233, 273, 338/274, 308, 322, 327, 329; 29/610, 613, 619, 620, 621; 252/518, 518.3, 521, 521.3; 427/101-103, 123, 126

[56] References Cited

U.S. PATENT DOCUMENTS

| | | | |
|---|---|---|---|
| 3,064,070 | 11/1962 | Douglass et al. | 338/274 X |
| 3,136,973 | 6/1964 | Randolph | 338/273 |
| 3,167,451 | 1/1965 | Tierman | 427/101 X |
| 3,380,936 | 4/1968 | Masuyama et al. | 338/20 X |
| 3,725,836 | 4/1973 | Wada et al. | 338/21 |
| 3,753,198 | 8/1973 | Shimizu | 338/20 |
| 3,760,318 | 9/1973 | Masuyama et al. | 338/20 |
| 3,768,058 | 10/1973 | Harnden, Jr. | 338/20 |
| 3,808,575 | 4/1974 | Brandt | 338/276 X |

*Primary Examiner*—C. L. Albritton
*Attorney, Agent, or Firm*—Quarles & Brady

[57] ABSTRACT

A thick film varistor comprises a varistor film sandwiched between a pair of electrodes, one of which is in contact with a cylindrical substrate. Alternatively, the electrodes may be positioned on the same surface of the film—either in contact with the substrate or the surface of the film opposite the substrate. The preferred method of manufacture involves applying a terminating layer to each end of the substrate, forming the varistor film and the electrodes on the substrate in the desired configuration, attaching a lead wire to each end of the substrate in electrical contact with an adjacent terminating layer, and enclosing the varistor film within a conformal coating.

16 Claims, 9 Drawing Figures

THICK FILM VARISTOR AND METHOD OF MAKING THE SAME

BACKGROUND OF THE INVENTION

This invention relates to a varistor, and more particularly to a varistor having a thick film formed on a substrate and a method of making the same. A varistor is a voltage variable resistor, and its electrical behavior is commonly described by the following characteristic relationship:

$$I = (V/C)^{\alpha}$$

wherein:

$I$ = current flowing through the varistor;
$V$ = voltage across the varistor;
$C$ = constant;
$\alpha$ = constant > 1; measure of the non-linearity of the varistor.

There are a number of varistors known in the art in a discrete component form, and they commonly include varistor materials formulated with zinc oxide. In U.S. Pat. No. 3,496,512, granted on Feb. 17, 1970, to Matsuoka, et al., a varistor is disclosed which includes a sintered body of zinc oxide with silver paint electrodes applied to opposite surfaces. The properties are dependent upon the bulk of the device; i.e., the non-linearity is determined to a considerable extent by the composition of the sintered body, and the value of C is controlled by the dimension of the body between the electrodes. There are many other devices of a similar construction in which the sintered body includes together with zinc oxide various metal oxides to effectuate an increase in the non-linearity property. See, for example, U.S. Pat. No. 3,632,528 issued on Jan. 4, 1972, to Matsuoka, et al., for "Lead-Modified Zinc Oxide Voltage Variable Resistor"; U.S. Pat. No. 3,634,337 issued on Jan. 11, 1972, to Matsuoka, et al., for "Barium-Modified Zinc Oxide Voltage Variable Resistor"; U.S. Pat. No. 3,598,763 issued on Aug. 10, 1971, to Matsuoka, et al., for "Manganese-Modified Zinc Oxide Voltage Variable Resistor"; and U.S. Pat. No. 3,699,058 issued on Oct. 17, 1972, to Matsuoka, et al., for "Uranium-Modified Zinc Oxide Voltage Variable Resistor."

Also, varistors have been introduced in a thick film form for use in integrated circuit applications. The patent issued to Wada, et al., on Apr. 3, 1973, for "Thick Film Varistor and Method For Making The Same," discloses a thick film varistor which is made by mixing a zinc oxide composition with a glass material and a liquid vehicle to form a paste. The paste is applied to a flat substrate and heated to a temperature sufficient to evaporate the liquid vehicle and melt the glass material to bond the zinc oxide composition particles and form a thick film. Suitable electrodes are then applied to the surface of the thick film to provide a varistor having a coplanar configuration, i.e., one in which the electrodes are on the same surface of the film. As an alternative, the paste can be applied to an electrode, which is disposed on a substrate, and heated in a similar manner. A second electrode is then applied to the resulting thick film on its surface opposite the electrode which is in contact with the substrate to provide a varistor having a parallel plate configuration, i.e., one in which the electrodes are on opposite surfaces of the film.

Other thick film varistors have been formed on flat substrates, and these varistors include varistor materials containing oxides other than zinc. U.S. Pat. No. 3,900,432 granted to Marcus, et al., on Aug. 19, 1975, for "Varistor Compositions" discloses thick film varistors and compositions containing doped iron oxides and glass powders. The thick film varistors shown and described in U.S. Pat. No. 3,916,366 issued to Jefferson on Oct. 28, 1975 for "Thick Film Varistor And Method Of Making The Same" have varistor materials including nickel oxide and lithium carbonate.

Although thick film varistors have been made, the art is deficient in not providing a thick film varistor in a discrete component form. Such varistors would be desirable since resistors and capacitors having a film deposited on a substrate in a component form are readily available. For example, a resistor of this type is disclosed in the patent issued to Brandt, et al., U.S. Pat. No. 3,808,575, on Apr. 30, 1974, entitled "Cermet Fixed Resistor with Soldered Leads." In this device, a resistive layer is deposited on a cylindrical substrate with openings at opposite ends. A layer is disposed on each end of the substrate in electrical communication with the resistive layer, and solder coated lead wires are within the substrate openings. A strong union is formed between the lead wires and the resistor body, yet the device is relatively inexpensive and easy to manufacture.

It is against this background that the present invention introduces a varistor formed by thick film processing techniques which has the required varistor characteristics, such as a high non-linearity constant, and is volumetrically similar to other thick film electronic components.

SUMMARY OF THE INVENTION

The present invention contemplates a thick film varistor in which a varistor film and a pair of electrodes are applied to a cylindrical substrate. The electrodes may be positioned on opposite surfaces of the film with one of the electrodes in contact with the substrate to form a parallel plate configuration. Or, the electrodes may be bonded to the same surface of the film—either in contact with the substrate or the surface of the film opposite the substrate—to form a coplanar configuration.

In a preferred embodiment for a varistor having a parallel plate configuration, the cylindrical substrate has a central longitudinal opening to provide inner and outer longitudinal surfaces, and there is a terminating layer on each end of the substrate. Each electrode is in contact with one of the terminating layers, and the varistor film is positioned on the outer longitudinal surface of the substrate between the terminating layers and is sandwiched between the electrodes. A lead wire is inserted into the longitudinal opening of the substrate at each end in contact with one of the terminating layers, and a conformal coating covers the film and the electrodes. It is preferred that the varistors having coplanar configurations utilize identical components; however, the arrangement of the film and electrodes will of course depend upon the type of configuration desired. Both electrodes may be positioned on the outer longitudinal surface of the substrate, or on the surface of the film opposite the substrate surface; but, in both cases, each electrode must be in contact with one of the terminating layers.

The invention also contemplates a method of making such thick film varistors involving formation of the varistor form and electrodes as layers. In general, a varistor having a parallel plate configuration is made by applying a terminating layer to each end of a cylindrical substrate, applying an electrode paste to the longitudinal surface of the substrate and in contact with one of the terminating layers and heating to the paste to form a first electrode, applying a varistor paste to the longitudinal surface of the substrate and to the first electrode, applying an electrode paste to the varistor paste and in contact with the other of the terminating layers and heating the varistor paste and the electrode paste to form a varistor film and a second electrode, and attaching a lead wire to each end of the substrate and in electrical contact with one of the terminating layers.

A varistor having either type of coplanar configuration can be made by modifying the above sequence of steps. Both electrodes can be formed on the longitudinal surface of the substrate after application of the terminating layers, and the varistor film then can be formed on the longitudinal surface of the substrate and the electrodes. Or, the varistor paste can be applied to the substrate, the terminating layers applied to the substrate ends and the varistor paste, and the electrode paste applied to the varistor paste. The coated substrate is then heated to form the varistor film and the electrodes.

It is an object of the invention to provide a thick film varistor in a discrete component form.

It is another object of the invention to provide a thick film varistor in a discrete component form, and in both parallel plate and coplanar configurations.

It is still another object of the invention to provide a method of making a thick film varistor in a discrete component form, and a method which can readily be adapted to produce such a varistor in either a parallel plate or coplanar configuration.

It is a further object of the invention to provide a thick film varistor in a discrete component form having strong physical connections between the varistor body and the leads. Each lead wire is inserted into the longitudinal opening of the substrate with a firm mechanical fit, and there is a solder bond between each lead wire and its adjacent terminating layer.

It is a still further object of the invention to provide a thick film varistor in a discrete component form that is relatively inexpensive and easy to manufacture.

The foregoing and other objects and advantages of the invention will appear from the following description. In the description reference is made to the accompanying drawings which form a part hereof, and in which there is shown by way of illustration and not of limitation preferred embodiments of the invention. Such embodiments do not represent the full scope of the invention, but rather the invention may be employed in a variety of forms, and reference is made to the claims herein for interpreting the breadth of the invention.

DESCRIPTION OF THE PREFERRED EMBODIMENTS

Figure 1:
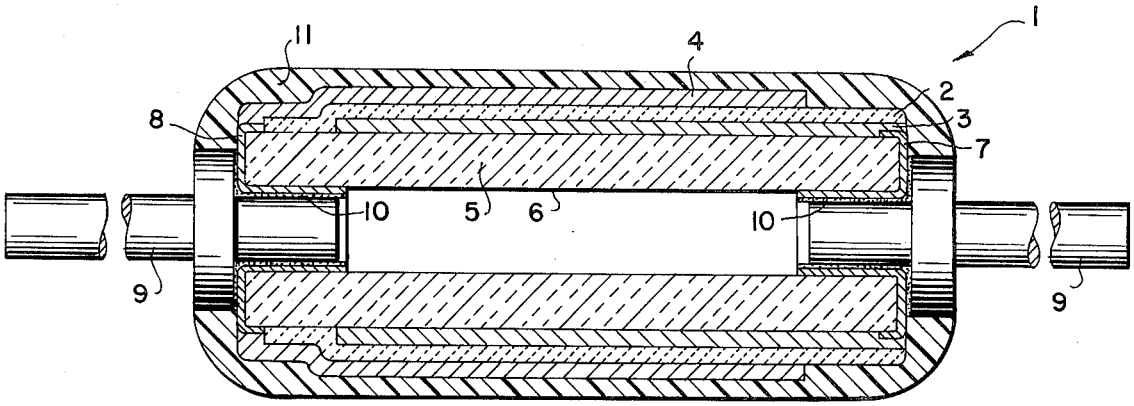
FIG. 1 is a view in cross section of a thick film varistor embodying the present invention.

Referring to FIG. 1 of the drawings, there is shown a thick film varistor 1 in a discrete component form having a parallel plate configuration. The varistor 1 includes a varistor film 2 intermediate a pair of electrodes 3 and 4, one of the electrodes 3 being in direct contact with an insulating substrate 5. The substrate 5 has a circular, cylindrical shape, and it has a central opening 6 extending throughout its length. Terminating layers 7 and 8 are disposed on the opposite ends of the substrate 5, the terminating layer 7 being in electrical contact with an end of one of the electrodes 3 and the other terminating layer 8 being in electrical contact with an end of the other electrode 4. A pair of lead wires 9 are attached to the ends of the substrate, each lead wire 9 communicating with one of the terminating layers 7 and 8. There is an interference fit between each lead wire 9 and the central opening 6 of the substrate 5, and a solder bond 10 is provided to strengthen the connections. A protective, conformal coating 11 covers the varistor 1 and protects the varistor film 2 and the electrodes 3 and 4 from the environment.

Figure 2:
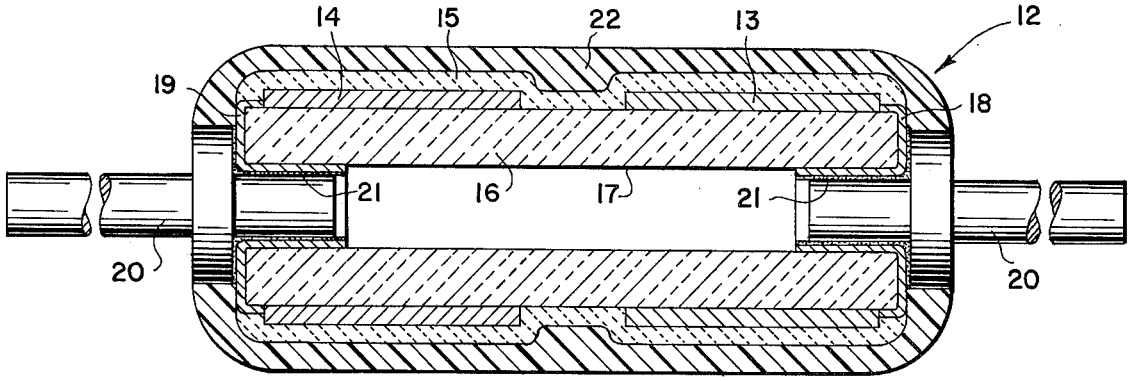
FIG. 2 is a view similar to FIG. 1, but comprising another embodiment of the present invention.

An alternative embodiment is shown in FIG. 2 in which there is a varistor 12 having a coplanar configuration. A pair of electrodes 13 and 14 are joined to the same surface of a varistor film 15, and both electrodes 13 and 14 are in direct contact with an insulating substrate 16. The substrate 16 has a central opening 17, terminating layers 18 and 19 on opposite ends in communication with the electrodes 13 and 14, lead wires 20 attached to the ends with an interference fit and a solder bond 21, and a conformal coating 22.

Figure 3:
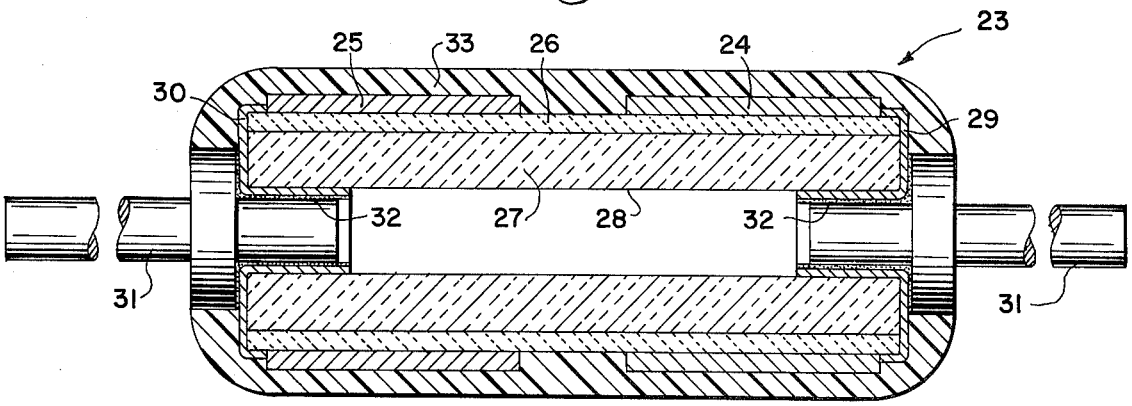
FIG. 3 is a view similar to FIG. 1, but comprising yet another embodiment of the present invention.
Figure 4A:
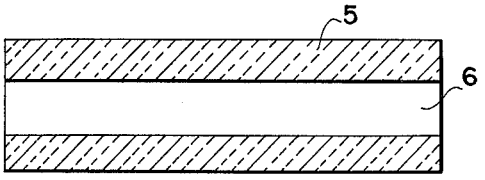
FIGS. 4*a*–4*f* constitute a schematic portrayal of the steps of a preferred method for practicing the invention.
Figure 4B:
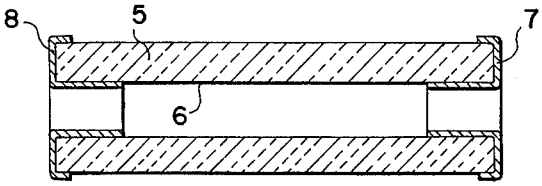
Figure 4C:
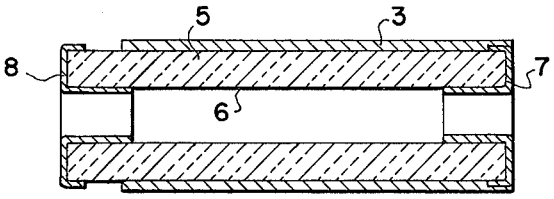
Figure 4D:
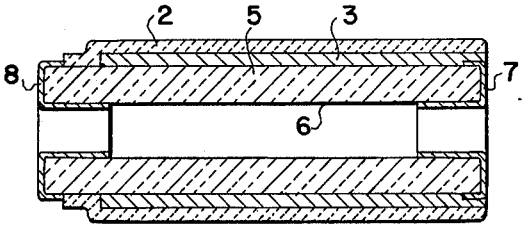
Figure 4E:
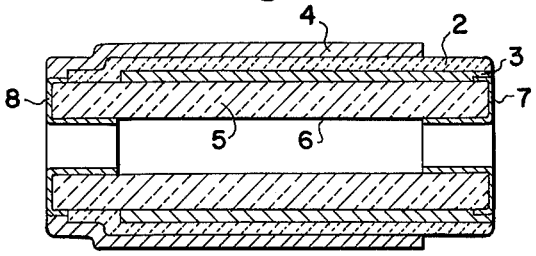
Figure 4F:
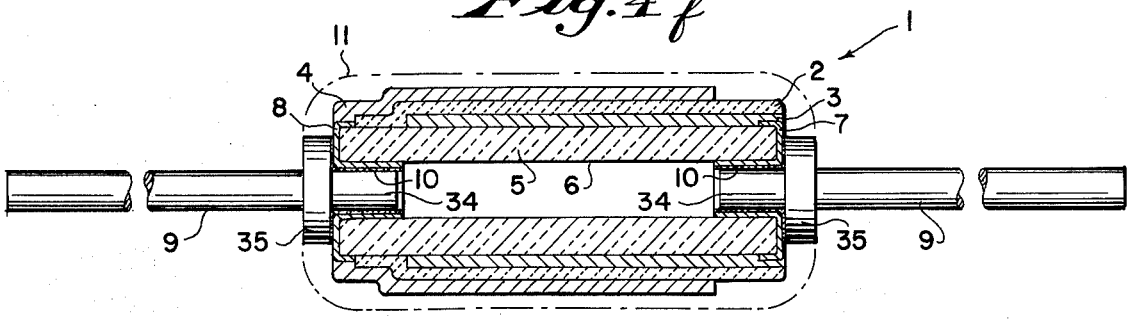

A varistor 23 comprising another embodiment of the invention is shown in FIG. 3; and, it has, like the embodiment shown in FIG. 2, a coplanar configuration. A pair of electrodes 24 and 25 are joined to the same surface of a varistor film 26; however, the varistor film 26 is disposed on a substrate 27, and both electrodes 24 and 25 are on the surface of the varistor film 26 opposite the substrate 27. The substrate 27 has a central opening 28, terminating layers 29 and 30 on opposite ends in communication with the electrodes 24 and 25, lead wires 31 attached to the ends with an interference fit and a solder bond 32, and a conformal coating 33.

Referring now to FIGS. 4*a* through 4*f*, the preferred method of making a varistor with a parallel plate configuration, such as that shown in FIG. 1, involves first applying the terminating layers 7 and 8 to the ends of the substrate 5. The substrate 5 is preferably composed of a ceramic material such as alumina comprising approximately 96 percent aluminum oxide, although other materials having similar insulating properties may be used. The substrate 5 is formed into a circular, cylindrical or other desired configuration by either extrusion or pressing, and it is then sintered to provide a hard base for further processing. A more detailed description of a method of manufacturing an insulating substrate for use in resistors, but which can also be used in making the thick film varistors of the present invention, can be had by reference to U.S. Pat. No. 3,329,922.

The terminating layers 7 and 8 are preferably a silver, palladium-silver or palladium-gold mixture, and one suitable mixture is Silver Paste 8706, sold commercially by E. I. DuPont de Nemours and Company, Wilmington, Del., which comprises approximately 66–69 percent silver, 3.7–5.9 percent glass frit, and the remainder, an organic carrier. This mixture has the rheology of an ink, and it is applied sequentially to each end of the substrate 5 in a manner such that it will flow partially into the central opening 6 and will adhere to both the inner and outer longitudinal surfaces of the substrate 5.

The electrode 3 is then applied to the outer longitudinal surface of the substrate 5 in contact with the terminating layer 7. The electrode 3 is deposited on the substrate 5 in a paste form, and this can be accomplished by rolling the substrate 5 over an applicator containing the paste or by using any other suitable technique such as a transfer wheel. The preferred electrode paste, like the terminating layer material, is a silver, palladium-silver or palladium-gold mixture, and it has been found to be advantageous to use identical mixtures such as Silver Paste 8706, for both the terminating layers 7 and 8 and the electrode 3. The paste is applied to a major portion of the outer longitudinal substrate surface, and it is then dried to evaporate any liquid constituents and fired at a temperature from about 850° to 1200° C to form the electrode 3 and to provide a strong bond between the electrode 3 and the substrate 5.

The next step is to form the varistor film 2 on the electrode 3 and on the portion of the outer longitudinal surface of the substrate 5 not covered by the electrode 3. The varistor film preferably comprises zinc oxide with metal oxide additives and a glass frit material. A suitable composition for the varistor film 2 includes a semi-conductive material consisting of, by mole percent, approximately 98.8 percent zinc oxide, 0.5 percent chromium oxide, 0.2 percent cobalt oxide and 0.5 percent manganese oxide, and a glass frit material containing, by weight percent, approximately 11 percent boric anhydride, 62 percent bismuth trioxide, 11 percent silicon dioxide, 8 percent cobalt oxide and 8 percent manganese dioxide. A varistor paste is formulated by mixing, by weight percent, about 90 percent of the semiconductive material with about 10 percent of the glass frit material, and then combining this mixture with an organic carrier. The paste comprises, by weight, approximately 80 percent of the mixture and 20 percent of the organic carrier, the carrier containing a vehicle consisting of, by weight percent, approximately 91.8 percent tridecanol, 7.7 percent ethyl cellulose, and 0.5 percent Santicizer, and an effective amount of butyl carbito acetate to achieve a paste viscosity within the range of about $10^4$ to about $10^5$ cps. The varistor film 2 is formed by applying the varistor paste by a screen printing technique or a transfer wheel, and heating it to drive off the organic carrier. Additional coats of the paste can be deposited to adjust the thickness of the resulting thick film 2.

The electrode 4 is applied to the surface of the varistor film 2 opposite the surface joined to the electrode 3 and the substrate 5, so that it is in contact with the terminating layer 8. An electrode paste—which can be the same mixture used in forming the electrode 3—is deposited on the varistor film, and it is dried to remove any liquids. The coated substrate 5 is then placed in a furnace, and it is fired at a temperature of about 850° to about 1200° C to form the thick film 2 and the electrode 4 which harden upon exposure to high temperatures.

The next step is to attach the lead wires 9 to the ends of the substrate 5. Each lead wire 9 has a head end 34 and a radially extending collar 35. A 90-10 solder 10 comprising about 90 percent lead and about 10 percent tin is deposited on the head ends 34 and the lead wires 9 are then driven into opposite ends of the central opening 6 of the substrate 5. There is an interference fit between the head ends 34 and the central opening 6, and the 90-10 solder 10 is heated to form solder bonds between the head ends 34 and the terminating layers 7 and 8. A detailed description of driving lead wires into a resistor body can be had by reference to the aforementioned U.S. Pat. No. 3,808,575.

The protective, conformal coating 11 is then applied to the varistor, and it surrounds the varistor film 2 and the electrodes 3 and 4. A preferred coating material includes an epoxy resin, a phenolic resin, and a silica filler. Conventional solvents such as Cellosolve Acetate (ethylene glycol monoethyl ether ethyl acetate), methyl ethyl ketone, and alpha terpenol are added to develop a consistency suitable for application, and coloring pigments such as Pigment Dragenfeld 10363 and 10390 may be added. The coating material is heated to polymerize and cure the resin, and several layers are applied to develop a coating of desired thickness.

The embodiments shown in FIGS. 2 and 3 are preferably formed using the same materials employed in making the varistor of FIG. 1. The same basic method is also practiced; however, there are some modifications in the sequence of steps carried out in making either the varistor 12 or the varistor 23. The varistor 12 shown in FIG. 2 is made by initially forming the substrate 16, and then applying the terminating layers 18 and 19 to the ends of the substrate 16. Before the varistor film 15 is formed, the electrodes 13 and 14 are applied to the outer longitudinal surface of the substrate 16. An electrode paste is deposited on the substrate 16, and it is dried and fired at a temperature of about 850° to about 1200° C. Next, the varistor film is applied to the electrodes 13 and 14 and the portion of the outer longitudinal surface of the substrate 16 between the electrodes 13 and 14. A varistor paste is deposited on electrodes 13 and 14 and the substrate 16, and it is heated to drive off liquid components. The coated substrate is fired at a temperature from about 850° to about 1200° C; and, the device is completed by attaching the lead wires 20 and applying the conformal coating 22 in the same manner as in the formation of the varistor 1.

In the manufacture of the varistor 23 shown in FIG. 3, after the substrate 27 is formed, the varistor film 26 is applied to the outer longitudinal surface of the substrate 27 in accordance with the procedure followed in making the varistors 1 and 12. The terminating layers 29 and 30 are then applied to the ends of the substrate 27, and the electrodes 24 and 25 are applied to the varistor film 26 on its surface opposite the substrate 27 with electrode 24 in contact with terminating layer 29 and electrode 25 in contact with terminating layer 30. The electrodes 24 and 25 are deposited in a paste form and dried, and the coated substrate is fired at a temperature from about 850° to about 1200° C. The lead wires 31 are attached, and the conformal coating 33 is applied in the same manner as in the formation of the varistor 1.

The preferred embodiments shown and described provide thick film varistors in a component form having either a parallel plate or coplanar configuration. Also, a method of manufacture is provided for forming the varistors in the desired configurations. As indicated above, however, various changes might be made in the preferred embodiments without departure from the spirit of the invention. For example, the components of the varistors may include a variety of materials. Also, although the preferred embodiments include a substrate having a central opening between its ends extending throughout its length, it should be apparent that the substrate can be formed with an opening at each end extending only partially into the substrate interior. With the substrate formed in this manner, the lead wires can be inserted in a manner similar to that described above. Furthermore, other structural attachments which provide a firm union between the lead wires and the substrate, such as disclosed in the patent issued to Steil, U.S. Pat. No. 3,329,922, on July 4, 1967, entitled "Welded Terminal Resistor" can be used. It should also be apparent that the substrate may have a configuration other than circular cylindrical; other cylindrical or tubular or other closed geometrical configurations could be suitably employed, and the work "cylindrical" as used herein contemplates these other forms. In view of these and other possible modifications, the invention is not intended to be limited by the showing or description herein, or in any other manner, except as may specifically be required.

We claim:

1. A thick film varistor, the combination comprising:
a cylindrical substrate made of an electrically insulating material and having openings at its opposite ends and an outer longitudinal surface;
a pair of terminating layers, one being on each end of said substrate;
a varistor film applied to the outer longitudinal surface of said substrate between said terminating layers;
a pair of electrodes applied to said varistor film, each being in electrical contact with one of said terminating layers; and
a pair of lead wires, each being inserted into an opening of said substrate at one end of said substrate and being in electrical contact with one of said terminating layers.

2. The thick film varistor as recited in claim 1, wherein one of said electrodes is disposed on one surface of said varistor film and in contact with the outer longitudinal surface of said substrate and the other of said electrodes is disposed on an opposite surface of said varistor film.

3. The thick film varistor as recited in claim 1, wherein both of said electrodes are disposed on the same surface of said varistor film and in contact with the outer longitudinal surface of said substrate.

4. The thick film varistor as recited in claim 1, wherein both of said electrodes are disposed on the same surface of said varistor film on the surface of said varistor film opposite the surface in contact with the outer longitudinal surface of said substrate.

5. The thick film varistor as recited in claim 1, wherein each of said lead wires has a head end inserted into an opening of said substrate with a firm mechanical fit and an opposite end extending from the opening, and there is a solder bond between each lead wire and adjacent terminating layer.

6. The thick film varistor as recited in claim 1, wherein a protective coating covers said varistor film.

7. The thick film varistor as recited in claim 6, wherein:
said substrate is an alumina-ceramic material; and
said protective coating includes an epoxy resin.

8. The thick film varistor as recited in claim 1, wherein said varistor film comprises zinc oxide.

9. The thick film varistor as recited in claim 8, wherein said varistor film includes:
at least one metal oxide selected from the group consisting of cobalt oxide, chromium oxide and manganese oxide; and
glass matrix consisting essentially of a borosilicate glass and at least one metal oxide selected from the group consisting of cobalt oxide and manganese oxide.

10. The thick film varistor as recited in claim 1, wherein said terminating layers include a cermet material selected from the group consisting of silver, palladium-silver alloy and palladium-gold alloy.

11. The thick film varistor as recited in claim 1, wherein said electrodes include a cermet material selected from the group consisting of silver, palladium-silver alloy and palladium-gold alloy.

12. A thick film varistor, the combination comprising:
a cylindrical substrate made of an electrically insulating material and having an outer longitudinal surface;
a pair of terminating layers, one being on each end of said substrate;
a first electrode applied to a major portion of the outer longitudinal surface of said substrate with an end in contact with one of said terminating layers;
a varistor film applied to a portion of the outer longitudinal surface of said substrate between said first electrode and the other of said terminating layers and which is applied to the surface of said first electrode opposite the longitudinal surface of said substrate;
a second electrode applied to the surface of said varistor film opposite said substrate and said first electrode with an end in contact with the other of said terminating layers; and
a pair of lead wires, each being attached to one end of said substrate and being in electrical contact with one of said terminating layers.

13. A method of making a thick film varistor, comprising the steps of:
applying a terminating layer to each end of a cylindrical substrate made of an electrically insulating material;
applying an electrode paste to the longitudinal surface of the substrate and in contact with one of the terminating layers and heating the paste to form a first electrode;
applying a varistor paste to the longitudinal surface of the substrate and to the first electrode;
applying an electrode paste to the varistor paste and in contact with the other of the terminating layers and heating the varistor paste and the electrode paste to form a varistor film and a second electrode; and
attaching a lead wire to each end of the substrate and in electrical contact with one of the terminating layers.

14. The method as recited in claim 13 wherein:
an electrode paste is applied to the longitudinal surface of the substrate and heated to form both the first and second electrodes after the terminating layers are applid to the substrate; and
the varistor paste is applied to the longitudinal surface of the substrate and to the first and second electrodes and heated to form the varistor film.

15. The method as recited in claim 13, wherein:
the varistor paste is applied to the longitudinal surface of the substrate before the terminating layers are applied;

the terminating layers are applied to the ends of the substrate and the varistor paste; and an electrode paste is applied to the varistor paste and is heated along with the varistor paste to form the first and second electrodes and the varistor film, each of the electrodes being in contact with one of the terminating layers.

16. The method as recited in claim 13, wherein the varistor film is enclosed within a conformal coating.

* * * * *